United States Patent [19]

Becker

[11] 4,444,611

[45] Apr. 24, 1984

[54] PORTABLE LABELING MACHINE

[75] Inventor: Werner Becker, Hirschhorn, Fed. Rep. of Germany

[73] Assignee: Esselte Pendaflex Corporation, Garden City, N.Y.

[21] Appl. No.: 352,372

[22] Filed: Feb. 25, 1982

[30] Foreign Application Priority Data

Mar. 4, 1981 [CH] Switzerland ..... 1441/81

[51] Int. Cl.[3] ..... B65C 11/02

[52] U.S. Cl. ..... 156/384; 101/288; 156/577; 156/579; 156/584; 156/DIG. 49

[58] Field of Search ..... 156/384, 361, 574, 577, 156/579, 576, 584, DIG. 48, DIG. 49; 101/288

[56] References Cited

U.S. PATENT DOCUMENTS

| | | | |
|---|---|---|---|
| 3,231,446 | 1/1966 | Satas | 101/288 |
| 3,934,507 | 1/1976 | Geri | 156/384 |
| 4,041,863 | 8/1977 | Mullen et al. | 101/288 |

*Primary Examiner*—Michael G. Wityshyn

*Attorney, Agent, or Firm*—Anthony J. Casella; Gerald E. Hespos

[57] ABSTRACT

The present machine is intended for the printing of selected characters on labels borne by a continuous tape (13) passing over a print table (11) and driven by a chassis (22) imparted a reciprocating movement by the operating of a trigger.

In order to prevent the strip of labels from being pulled towards the outside at the time of the pulling off of the label said machine has a hand brake (28, 30) located in front of the print table.

This brake comprises a pivoting brake shoe (28) which is placed out of operation during the transport stroke of the continuous strip (13) by an interceptor (32) which is fastened to the transport chassis (22). This arrangement is established in order to permit a precise and effective braking action without requiring recourse to tolerances which are incompatible with mass production.

6 Claims, 5 Drawing Figures

PORTABLE LABELING MACHINE

The object of the present invention is a portable labeling machine intended to be actuated by one hand in order to print and attach labels onto selected articles intended for sale.

Certain known labeling machines capable of carrying out this function comprise, like the machine of the present invention, a housing provided with an operating handle, a printing unit and a print table located within said housing and adapted to come together for the striking of selected characters, a step-by-step device for driving a continuous strip bearing self-adhesive labels along an internal circuit passing over the print table and comprising a chassis for the transport of the said continuous strip, a lever-shaped trigger connected on the one hand to the printing unit to cause the striking of the selected characters on a label of the continuous strip upon each pull and on the other hand to the transport chassis to cause the advance of said continuous strip by a step corresponding to the length of one label upon each release, a device for separating and dispensing labels from the continuous strip outside of the housing in order to permit their attachment by adherence to the articles to be labeled and a periodically acting device for the retaining of the continuous strip of labels, said device being arranged on its circuit in front of the printing table and the separating and dispensing device and being adapted to retain the said strip between its succesive movements of advance.

On the label-bearing strip, which consists in general of a ribbon with glossy or waxed surface, the labels forming a continuous sequence, each of them separated from the preceding one by a relatively pronounced cutting line provided in order to facilitate the tearing off thereof after adhesion to the articles to be labeled and at the time of the withdrawal of the machine by the operator in order to shift to the following article.

In known machines of this type the presence of a device for retaining the label strip in front of the printing table and of the separating and dispensing device is based on the necessity of providing resistance to the pulling force resulting from this tearing off of the label so as to avoid any possible entrainment of the strip which would have the effect that the following label would be out of position with respect to the placing of striking of the characters and/or a modification in the final result of the transport stroke of the strip, perverting it.

The detention device of these labeling machines consists of a brake lever actuated by the trigger. The lower end of this lever is applied flexibly against the strip of labels and against a rearward extension of the print table by the release movement of the trigger and is freed from said application by its pulling movement.

It results from this design that the brake lever acts only at the end of the release stroke of the trigger, that is to say in the position of rest of the latter, this braking action ceasing upon the slightest pressure on the trigger. In this same type of design there is known a detention device in which the braking action is progressively relaxed until done away with during the course of the pull on the trigger, which already constitutes an improvement but fails to solve the problem completely.

Furthermore, the precision of the synchronization of the moment of release of the brake formed in this manner with the duration of the transport of the strip by the transport chassis after each labeling operation cannot be assured perfectly in mass production; a certain safety margin is therefore applied in the selection of the tolerances, which safety margin goes in the sense of a slight increase in the time of release of the brake as compared with the duration of the transport of the strip rather than in the other direction.

With strips of labels which are in good agreement with the standards on basis of which these machines have been designed and in case of normal use these two characteristics which are inherent in the said design do not have any harmful effect on the final result of the labeling operation.

However, in case of improper use of the machine and/or when the labeling strips differ excessively from the standards, defective products and improper operation of the transport of the strip may occur.

Thus, for example, when the trigger is retained or already experiences initial pressure on the part of the user at the precise moment when the label which has just been attached is torn away from the following label which is still detained by the label-bearing strip, as the strip is not detained by the brake it can be entrained over a distance which is larger or smaller depending on the amount of the pull resulting from this tearing, causing an offset of the printing of the characters on a number of following labels before this distance is taken up by the displacements of the transport chassis.

This phenomenon also takes place, although to a lesser extent, when the tearing off of the label takes place during the time of the aforementioned safety margin which has been applied to the duration of the release of the brake.

On the other hand this phenomenon is aggravated when the tear line separating the labels is insufficient and opposes excessive resistance to the tearing. In the present state of the art, in order to avoid this drawback there is a tendency to cutting the labels deeper with the risk of reaching the continuous strip which bears them, which may cause the outright tearing of the strip upon the transportation pull and the interruption thereof.

These labeling machines therefore require both the application of severe tolerances and the selection of the label strips to be employed and compliance with the standards for optimum use.

The object of the present invention is to avoid these two drawbacks. For this purpose, the portable labeling machine of the invention is characterized by the fact that its device for the detention of the strip of labels comprises a brake the movable member of which is pressed against a strip of labels and against a stop by a spring of continuous action, and an interceptor (32) fastened to one of the members actuated by the trigger and imparted movements synchronous with those of the step-by-step drive of the continuous strip of labels, the said interceptor having at least one element for the gripping and release of the movable brake member, the element being directed towards the latter and adapted to cooperate with it upon each transport stroke of the strip of labels, said interceptor having two active positions, one for the placing of the movable brake member out of operation by gripping and displacing it at the start of said transport stroke and the other for returning said movable brake member into operation at the end of the said transport stroke by release of the said movable member.

In this way the operation of the brake of this device for the detention of the strip of labels is directly related to the process of the transport of the strip, which makes it possible to assure optimal synchronization of the time of the placing out of operation of the brake with the duration of transport of the strip without requiring recourse to manufacturing tolerances which are too narrow for mass production of the machine as well as of the strips of labels. This type of connection also makes it possible to eliminate any influence of accidental pressing on the trigger during the phase of the adhering and tearing off of the label, since any idle return movement of the transport chassis between its two end-of-stroke positions caused by such a pressure has no effect on the braking of the strip of labels.

Other advantages, made possible as a result of this original design of the detention device will become evident from the following description.

The accompanying drawing shows one embodiment of the object of the invention by way of example.

Figure 1:
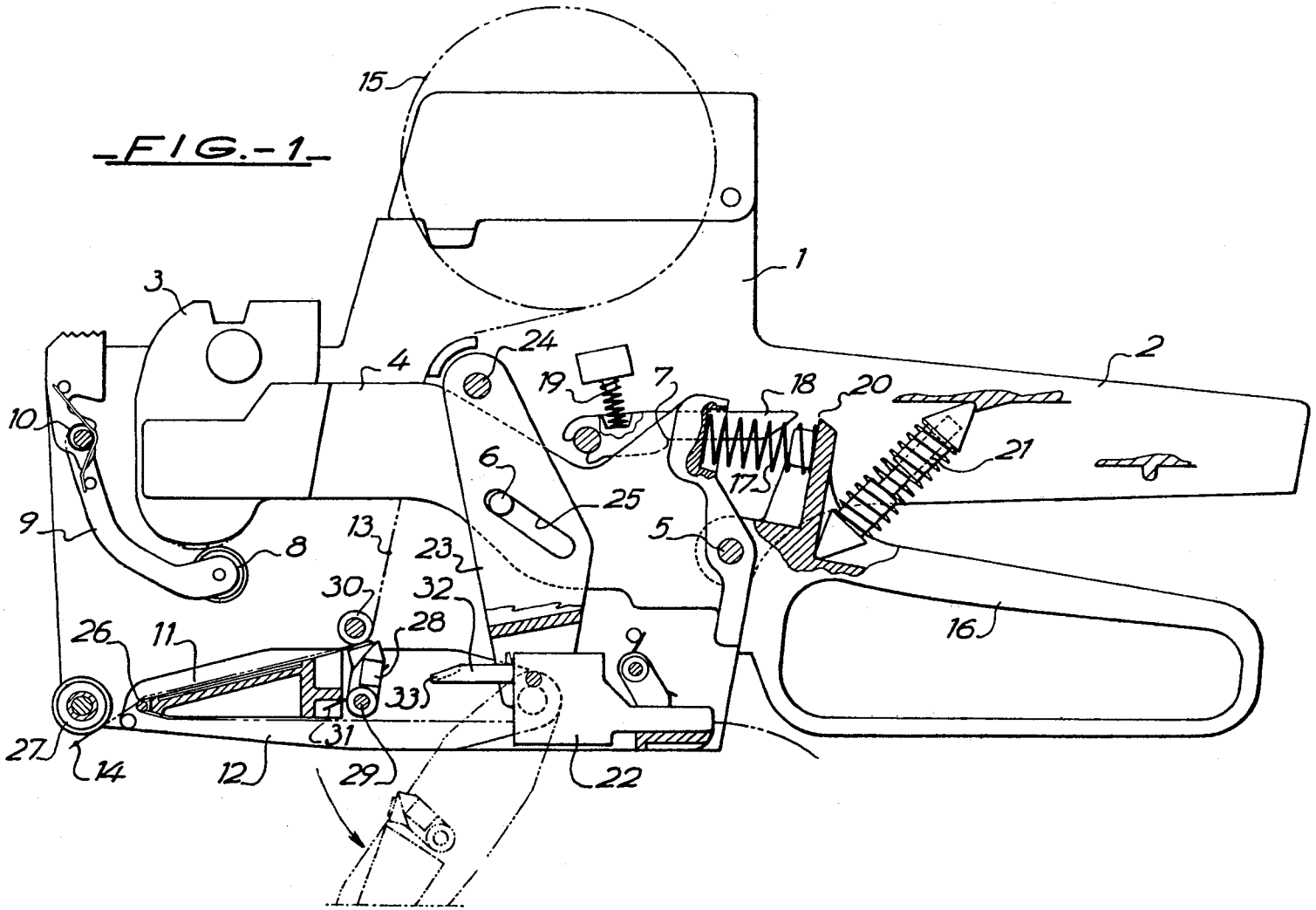
FIG. 1 is an overall view of its internal mechanism.

The portable labeling machine shown in its entirety in FIG. 1 comprises:

a housing 1 provided with a holding handle 2;

a printing unit comprising a print head 3 with rotary selector of integrated characters, which is fastened at the end of a lever 4 which is articulated on a pivot 5 and has a drive finger 6 and a stop notch 7, and a device for the inking of the said characters, consisting of a retractable inking roller 8 borne by a spring-loaded lever 9 articulated on a pivot 10;

a printing table 11 which is fixed in position in operation, borne by a support 12 which can be swung towards the outside of the housing in order to facilitate the use of a continuous strip 13 of self-adhesive labels 14 coming from a roll 15 located in the upper part of the housing 1;

a lever-shaped trigger 16, articulated on the aforementioned pivot 6, of the type assisted with uniform pressure by expansion, the combined action of which is assured by a cocking spring 17 , a detention pawl 18 with return spring 19 engaged in position of rest shown in said FIG. 1 in the stop notch 7 of the lever 4 and, in this position, opposing the action of the said spring, and a releaser 20, integrally connected with the trigger 16 and intended to free said action by disengagement of the pawl 18 from the stop notch 7. This trigger 16 is connected to the handle 2 by spring separator 21 having the function of bringing the assembly consisting of trigger 16, lever 4 and print head 3 back into the position of rest shown in the drawing at the time of its release;

a step-by-step drive device comprising a frame 22 for the transport of the continuous strip 13, which frame is driven by a lever 23 which is articulated on a pivot 24 and has an oblique slot 25 in which the drive finger 6 of the aforementioned lever 4 is engaged. This transport frame 22 is imparted a reciprocating movement upon each pressing releasing of the trigger 16 and its main function is to advance the continuous strip 13 by a length corresponding to the length of one label upon each release of the trigger 16. Its structure is shown in detail in FIG. 2 and 3 and will be described further below;

a device for the separating and dispensing of the labels 14 borne by the continuous strip 13, it consisting of the association of a hairpin-shaped reversal end 26 of the print table 11 the function of which is to separate the labels from the continuous strip and by a pressing roller 27 which makes it possible to adhere these labels by pressing the machine on the article to be labeled.

This mechanism is supplemented by a periodically acting device for detaining the continuous strip of labels, arranged on its circuit in front of the print table and of the label separating and dispensing device.

This detention device, which serves the purpose of the invention, is composed:

of a brake the movable member of which, consisting of a pivoting brake shoe 28 articulated on a pivot 29 borne by the swingable support 12 is pressed against the strip of labels 13 and against a stop 30 by a continuously acting spring 31. The stop 30 is formed of a freely turning roller covered in this case with an elastic material, but this detail is not indispensable.

of an interceptor 32, fastened in this case to the transport chassis 22 and directed towards the brake shoe 28, it having two elements for the gripping and release 33 of said shoe, only one of which is visible in FIG. 1.

This interceptor 32 is intended to cooperate with the brake shoe 28 upon each transport stroke of the strip of labels in order to synchronize the time during which the braking is placed out of operation with the duration of the said transport.

Figure 2:
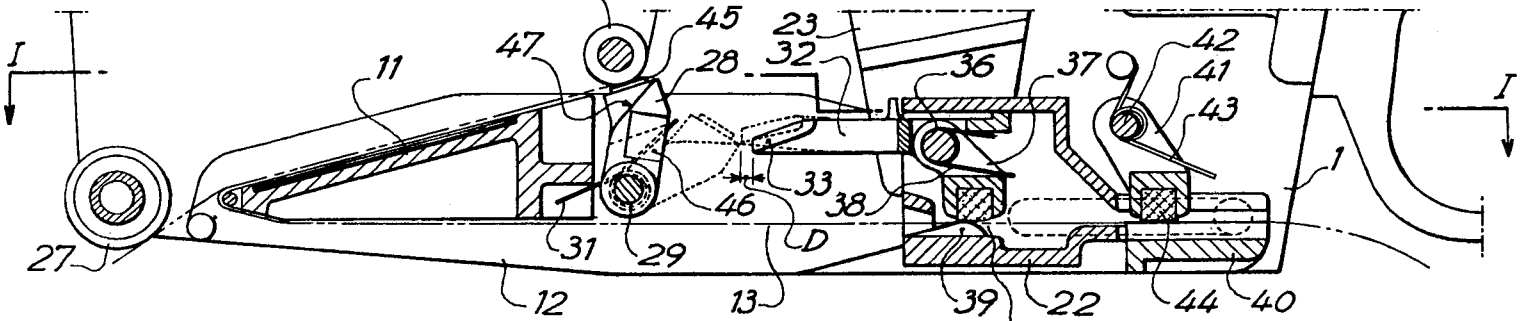
FIG. 2 is a partial view on a larger scale.
Figure 3:
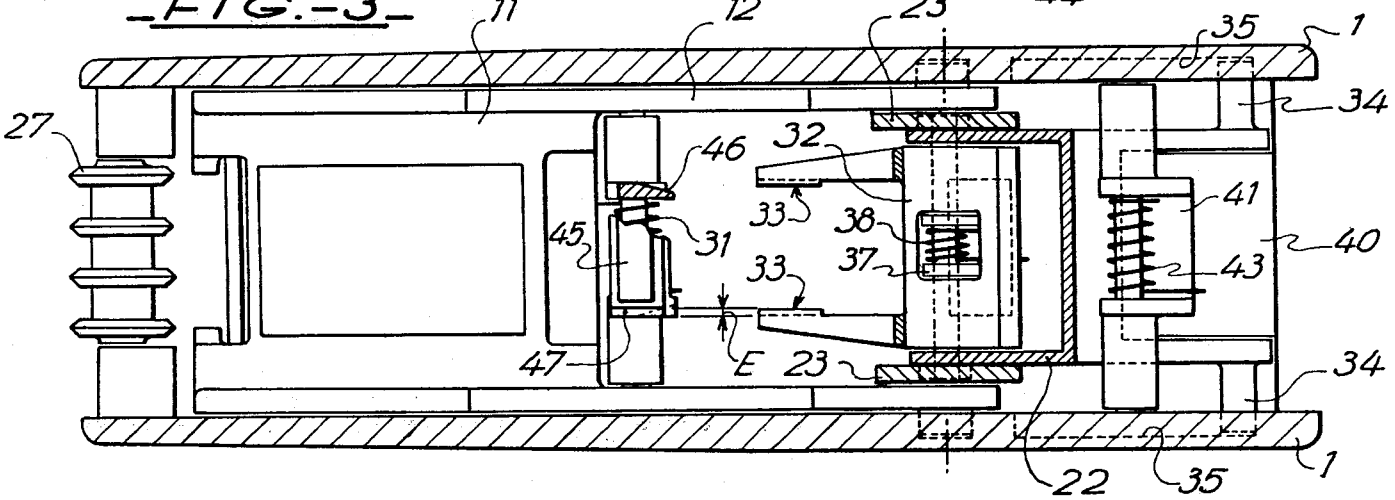
FIG. 3 is a top view of FIG. 2 along the section line I—I of the latter.

Together with the transport chassis 22 this interceptor is shown in detail in FIG. 2 and 3.

The transport chassis 22 is in the form of a small box guided in its rear portion, to the right in the drawing, by two lateral fingers 34 engaged in two guide slots 35 of the side walls of the housing 1 and driven in its front portion by the two side arms of the aforementioned lever 23 which bear a shaft 36 which traverses the said chassis. Within this chassis the interceptor 32 and a drive shoe 37 are articulated on the shaft 36. The rear portion of the interceptor 32 and the drive shoe 37 are subjected to the action of a spring 38 which has the effect of pressing the former against the upper wall of the chassis and the latter against hooking elements 39 which protrude from the bottom of said chassis. The continuous strip 13, which is not shown in FIG. 3 in order not to needless complicate the drawing, is engaged between the shoe 37 and the hooking elements 39 and emerges at the rear onto a fixed plate 40 where it is again pressed below a non-return shoe 41. This shoe 41 is articulated on a shaft 42 which is held by the walls of the housing 1 and is subjected to the action of a spring 43. The said shoes 37 and 41 have brake pads of semi-elastic material which are offset towards the rear with respect to the vertical line through their axis of rotation so as to present a reentrant braking trajectory towards the left on the elements 39 and on the plate 40.

The interceptor 32 has the shape, in top view (FIG. 3) of a fork the two branches of which are provided with the aforementioned gripping and release elements 33 on their ends and inner faces. These two elements are in the form of protruding inclined bars and are intended to intercept, grip and release the body of the brake shoe 28. This brake shoe 28 has a pad 45 which is also offset with respect to the stop roller 30 so as to present a reentrant braking trajectory on the said roller; it furthermore is provided on each of its two side faces with an inclined plane 46, visible in the partial cross section of said shoe shown in FIG. 3, and an entrainment ramp 47, these two elements being intended to facilitate the gripping and the entrainment of the said shoe by the interceptor 32. For this purpose the width E of each of the two ramps 47 of the shoe 28 and the projection of each of the two gripping elements 33 of the interceptor are selected substantially equal and arranged in the alignment with respect to the trajectory of the transport chassis, the two inclined planes 46 of the shoe 28 are arranged on the trajectory of the two gripping elements 33 of the two branches of the interceptor 32 and said branches must have sufficient elasticity to move apart upon encountering these two inclined planes and to close again behind said shoe in the position shown in FIG. 4.

Figure 4:
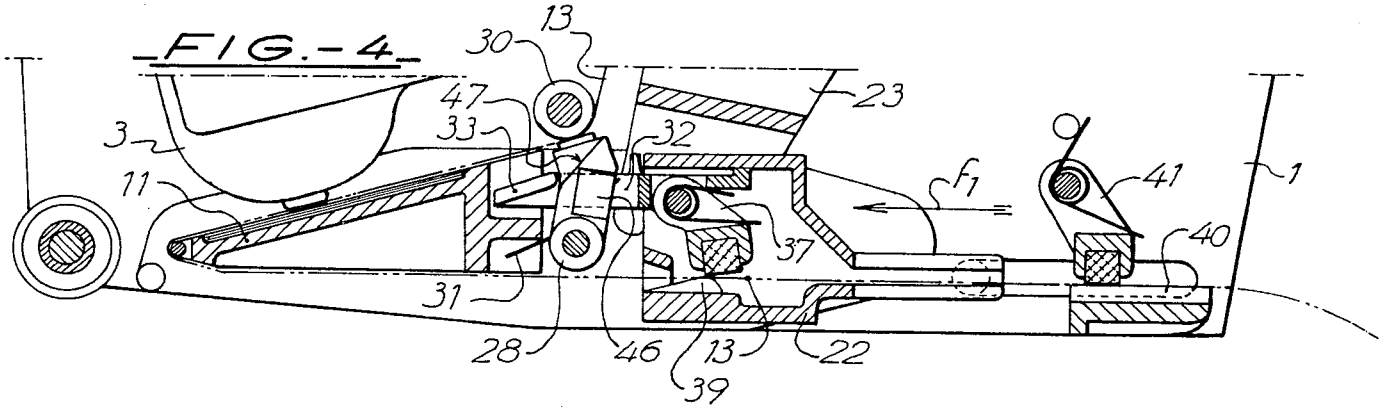
FIGS. 4 and 5 are two partial views similar to FIG. 2 but showing two different operating phases.
Figure 5:
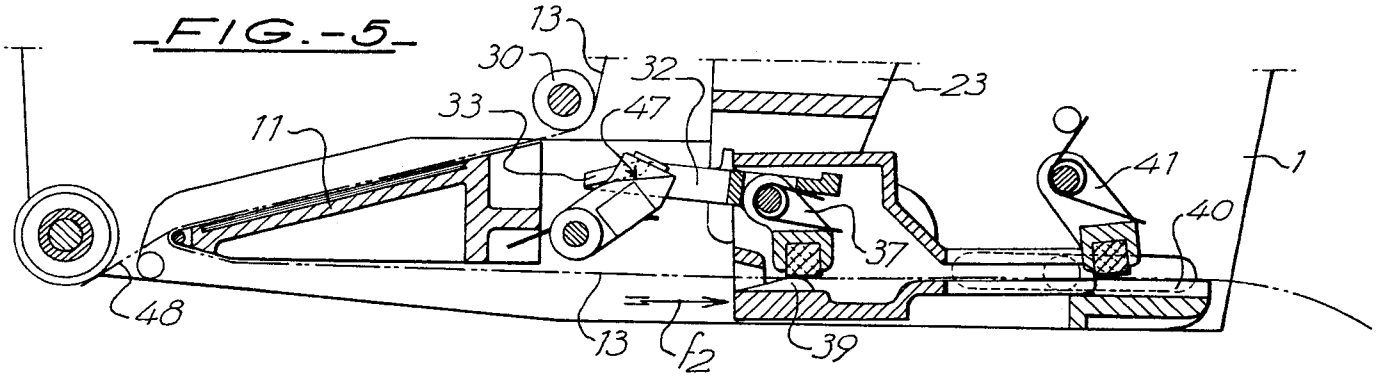

FIG. 2, 4 and 5 illustrate four prominent phases of operation of the detention device which has just been described.

FIG. 2 shows the phase of rest and also shown partially in thin dashed lines, the phase of release of the brake shoe 28 by the interceptor 32, FIG. 4 shows the phase of the gripping of the said shoe by said interceptor and FIG. 5 shows the phase of the entrainment of this shoe by said interceptor.

When the trigger 16 is pulled (FIG. 1), the transport chassis 22 moves together with the interceptor 32 which is associated with it in the direction towards the brake shoe 28. During this displacement, the non-return shoe 41 (FIG. 4) holds the continuous strip 13 pressed against the place 40, the entrainment shoe 37 releases the plate from its detention on the hooking elements 39 and the brake shoe 28 remains pressed against the stop roller 30, this latter fact preventing any displacement of the continous strip 13 on the print table 11, in accord with the purpose desired.

At the end of this return displacement of the transport chassis 22 the direction of which is indicated in FIG. 4 by the arrow $f_1$, the two gripping elements 33 of the interceptor 32 slide, while opening up, on the two ramps 46 of the brake shoe 28 and close again behind the latter, in the position shown in this figure. At the same time the selected characters are struck on a label of the continuous strip by the print head 3.

The device is thus ready for the phase of transport of the said continuous strip 13 by an advance step corresponding to the length of a label, but the braking thereof is still effected by the brake shoe 28.

Mention may be made here of one advantage resulting from the offset of the pad 45 of the brake shoe 28 which was already pointed out. The reentrant trajectory thus obtained on the stop roller 30 has the result that any pull on the continuous strip 13 resulting from the tearing of the label as a result of the removal of the machine from the object to be labeled has the effect of increasing the braking force opposed to this pull by the shoe 28. This feature is not indispensable but it constitutes and additional advantage which is permitted by this embodiment.

Upon the release of the trigger 16, the transport chassis 22 moves in opposite direction, as indicated by the arrow $f_2$ in FIG. 5, the gripping elements 33 of the interceptor 32 coming against the ramps 47 of the brake shoe and entraining the latter in this displacement, thus releasing the braking of the continuous strip 13 on the stop roller 30 while at the same time the said continuous strip is gripped by the entrainment shoe 37 by pressure against the hooking elements 39 of the transport chassis 22. During this transport, the printed label 48 is disengaged from the strip 13 and advances under the pressing roller 27.

Shortly before the end of this transport stroke, in the position shown in dashed lines in FIG. 2 the gripping elements 33 of the interceptor 32 are disengaged from the ramps 47 of the brake shoe 28 and release the latter which is then thrown by the spring 31 against the support roller 30, which causes the terminal braking of the continuous strip on said roller. The difference between the moment of this release and the end of the transport stroke, indicated by the distance D entered in this FIG. 2, is determined so as to compensate for the time of travel of the brake shoe in order to encounter the stop roller, so that the start of the braking of the continuous strip 13 coincides with the end of the said transport stroke. At this distance is a function of a length of stroke and of a spring force it will be adapted to the selection of these two characteristics. As a result this distance may even be considered practically nil in case of the selection of a large spring force and of a very short stroke.

At the end of said transport stroke, the members of the detention device are in the position of rest shown in FIG. 2, ready for a new cycle consisting of the same phases.

The principle of the gripping and release of a brake shoe by an interceptor connected to the transport chassis of the continuous strip makes it possible to assure good synchronization of the time of release of the braking with the duration of the transportation of the said continuous strip without requiring a precision which is incompatible with mass manufacture. This possibility, which is also in accord with the purpose pursued, is permitted by the direct dependence thus created of these two members which are responsible for the said functions and their immediate proximity. However, it is also possible to fix the interceptor 32 on another member selected from among those actuated directly or indirectly by the trigger 16, provided, however, that the said member is imparted movements which are synchronous with the step-by-step drive movements of the strip of labels, such as, for instance, the driving lever 23 of the transport chassis 22 or else the printing unit 3 or its support lever 4. In this latter case, in FIG. 1, the brake-interceptor assembly will be oriented in upward direction instead of left to right, the shoe 28 directed in direction opposite to and resting against the print table 11 which would play the role of the stop 30 and the interceptor 32 fastened on the support lever 4 of the printing unit and directed in the same manner towards the said shoe.

As this design of the detention device is independent of the type of actuating of the print unit it can be applied just as well to labeling machines with unassisted direct trigger as to machines having a print table 11 which is movable in work, associated with a movable or fixed print unit 3.

The mounting of the brake shoe 28 in a tilting support 12 bearing the print table 11 which is shown in the drawing is advantageous since it greatly facilitates the placing in operation of the continuous strip 13 at the same time as the control of the said shoe, but this detail is not indispensable and this shoe may be mounted on a pivot borne by the housing 1 of the machine, for instance in machines not having a swingable support of this type.

Likewise, the type of mobility of the brake shoe 28 may be other than pivoting. In particular it may be movable by translation.

The gripping and release action of the interceptor 32 can be obtained by some other means than in the elasticity of the two arms of a fork. For example, this action can be obtained by an engagement and disengagement system by cam from a pivoting hooking arm articulated to the transport chassis 22, in which the cam is masked during the movement of the said chassis. However, the structure described has the advantage of simplicity over this variant. Of course, the stop roller 30 which cooperates with the brake shoe 28 may be of a different kind.

Finally, as the structure itself of the transport chassis 22 shown by way of example is immaterial with respect to the action of the interceptor 32, the latter may be associated with all types of known chassis whether independent of or attached to a drive lever such as the lever 23.

I claim:

1. In a portable labelling machine comprising, a housing provided with an operating handle, a printing unit and a print table arranged in said housing and adapted to meet each other for the typing of selected characters, a step-by-step drive device for the driving of a continuous strip bearing self-adhesive labels along an internal circuit passing over the print table and comprising a transport chassis for said continuous strip, a lever-shaped trigger connected on the one hand to the printing unit to cause upon each pull thereof the typing of the selected characters on a label of the continuous strip and on the other hand to the transport chassis to cause upon each release thereof the advance of said continuous strip by one step corresponding to the length of one label, a device for separating the labels from the continuous strip and dispensing the said labels towards the outside of the housing to permit adhesive attachment thereof on items to be labelled, and a periodically acting device for the retention of the continuous strip of labels between its successive movements of advance, which periodically acting device is arranged on the said circuit of the strip of labels before the print table and the separating and dispensing device and comprises a brake shoe movable towards and away from said continuous strip of labels and a spring permanently urging said brake shoe against said continuous strip of labels, the improvement comprising:

a gripping and release means controlled by the trigger for:

(a) initial movement in a first direction towards said brake shoe upon trigger pull and gripping the said brake shoe without any displacement thereof at the end of said trigger pull;

(b) subsequent movement in a second direction opposite to said first direction upon trigger release and simultaneously drawing said brake shoe away from said continuous strip of labels against the bias of said permanently urging spring; and (c) release of said brake shoe for spring urged return thereof against said continuous strip of labels at the end of said trigger release, whereby trigger pull is without any effect on said brake shoe.

2. In a portable labelling machine comprising, a housing provided with an operating handle, a printing unit and a print table arranged in said housing and adapted to meet each other for the typing of selected characters, a step-by-step drive device for the driving of a continuous strip bearing self-adhesive labels along an internal circuit passing over the print table and comprising a transport chassis for said continuous strip, a lever-shaped trigger connected on the one hand to the printing unit to cause upon each pull thereof the typing of the selected characters on a label of the continuous strip and on the other hand to the transport chassis to cause upon each release thereof the advance of said continuous strip by one step corresponding to the length of one label, a device for separating the labels from the continuous strip and dispensing the said labels towards the outside of the housing to permit adhesive attachment thereof on items to be labelled, and a periodically acting device for the retention of the continuous strip of labels between its successive movements of advance, which periodically acting device is arranged on the said circuit of the strip of labels before the print table and the separating and dispensing device and comprises a brake shoe movable towards and away from said continuous strip of labels and a spring permanently urging said brake shoe against said continuous strip of labels, the improvement comprising:

gripping means driven by the trigger for:

(a) initial movement in a first direction towards said brake shoe upon trigger pull and gripping engagement with said brake shoe without any displacement thereof at the end of said trigger pull; and (b) subsequent movement in a second direction opposite to said first direction upon trigger release and simultaneously drawing said brake-shoe away from said continuous strip of labels against the bias of said permanently urging spring; and, means for releasing said gripping means from said brake shoe for spring urged return thereof against said continuous strip of labels at the end of said trigger release, whereby trigger pull is without any effect on said brake shoe.

3. The portable labelling machine of claim 2, wherein the print table is borne by a support which is swingable towards the outside of the housing, and wherein the brake shoe is mounted on said swingable support.

4. The portable labelling machine of claim 2, wherein said gripping means are formed on a fork having two arms which are resilient so as to spread apart upon encountering said brake shoe and to close again behind said brake shoe at the end of said trigger pull.

5. The portable labelling machine of claim 4, wherein said brake shoe is pivotable and comprises lateral inclined plane means for easing the spreading apart of said arms.

6. The portable labelling machine of claim 2, wherein said brake shoe is pivotable and comprises lateral ramp means for engagement by said gripping means at the start of said subsequent second direction movement to pivot said brake shoe and subsequently ease the releasing of said gripping means from said brake shoe.

* * * * *